US006039188A

United States Patent [19]

Lee

[11] Patent Number: 6,039,188

[45] Date of Patent: Mar. 21, 2000

[54] SOCKET DISPLAYING DEVICE

[76] Inventor: Jack Lee, No.53, Nan Shi Keng, Da Nan Village, May Shan Hsiang, Chia Yi Hsien, Taiwan

[21] Appl. No.: 09/376,404

[22] Filed: Aug. 18, 1999

[51] Int. Cl.[7] ..... B65D 85/02

[52] U.S. Cl. ..... 206/758; 206/378; 206/468; 206/806

[58] Field of Search ..... 206/375, 376, 206/378, 446, 468, 477, 758, 775, 806; 211/70.6; 220/4.01

[56] References Cited

U.S. PATENT DOCUMENTS

| | | | |
|---|---|---|---|
| 2,779,496 | 1/1957 | Henderson | 206/806 |
| 3,530,978 | 9/1970 | Lewandowski | 206/468 |
| 4,535,890 | 8/1985 | Artusi | 206/468 |
| 5,083,664 | 1/1992 | Feng | 206/376 |
| 5,715,951 | 2/1998 | Dembicks | 211/70.6 |
| 5,725,107 | 3/1998 | Dembicks | 211/70.6 |
| 5,850,916 | 12/1998 | Petterson et al. | 206/468 |
| 5,918,741 | 7/1999 | Vasudeva | 206/376 |
| 5,975,297 | 11/1999 | Kao | 206/493 |

*Primary Examiner*—Jim Foster
*Attorney, Agent, or Firm*—Charles E. Baxley, Esq.

[57] ABSTRACT

A socket displaying device includes a back plate with two grooves defined in two sides thereof and a stop extends from the first end of the back plate. A frame is slidably engaged with the two grooves of the back plate and has two side plates between which a plurality of chambers are defined so as to receive sockets therein. Each of the side plates has a flange extending toward the other side plate. The frame has a first end thereof so as to engage with the stop of the back plate when the frame is in its first position. An aperture is defined in the second end of the frame so that when the frame is pulled away from the back plate, the stop is engaged with the aperture so limit the frame from dropping from the back plate.

5 Claims, 7 Drawing Sheets

SOCKET DISPLAYING DEVICE

FIELD OF THE INVENTION

The present invention relates to a socket receiving and displaying device which includes a back plate and a frame which is slidably connected to the back plate and has a plurality of receiving chambers in each of which a socket is received.

BACKGROUND OF THE INVENTION

A conventional socket receiving and displaying device generally includes a box-like member for a socket or sockets to be received therein, and a card which is connected to the box and has a hole defined therein. The card is hung on a wall and the box member is made of transparent material so that the customers can see the socket that he/she wants to buy. Nevertheless, the displaying device is no more than a package when the customers buy the sockets home so that the displaying device will be discarded. The users put the sockets into a socket receiving or retaining device which is suitable to be carried with the users. In other words, the displaying device cannot meet the needs of the users who needs a displaying device which can be carried with him/her so that the users do not need to purchase sockets receiving device suitable to be carried with the users.

The present invention intends to provide a socket displaying device which has a strong structural strength and the sockets can be seen directly. The displaying device is suitable to be carried and used as a general tool receiving rack.

SUMMARY OF THE INVENTION

In accordance with one aspect of the present invention, there is provided a socket displaying device comprising a back plate having two grooves defined in two sides thereof and a stop extending from the first end of the back plate. A frame has two rails on two sides thereof so as to slidably engaged with the two grooves of the back plate. Two side plates extend from the frame and a plurality of boards are connected between the two side plates so as to define a plurality of chambers for receiving sockets therein. Each of the side plates has a flange extending toward the other side plate. The frame has a first end which is engaged with the stop when the frame is in its first position. An aperture is defined in the second end of the frame so as to engage with the stop when the frame is in its second position.

The primary object of the present invention is to provide a socket displaying device which can be used as a tool rack which is easily carried by the users.

Another object of the present invention is to provide a socket displaying device which has a frame in which sockets are received, and a back plate relative to which the frame is slidably engaged.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
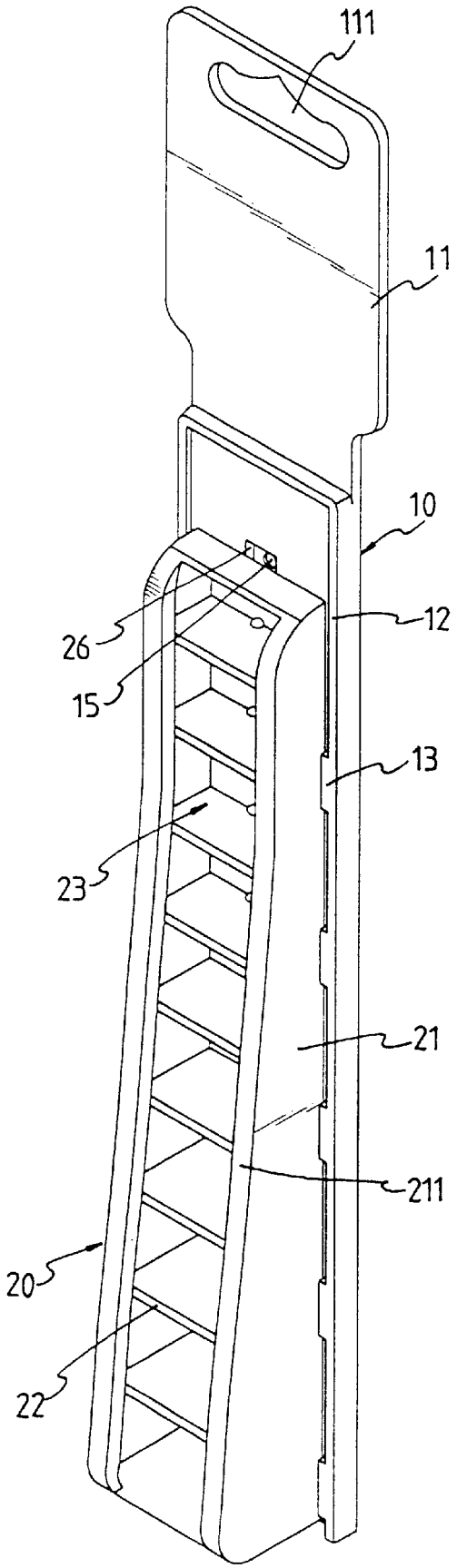
FIG. 1 is a perspective view of the socket displaying device in accordance with the present invention.
Figure 2:
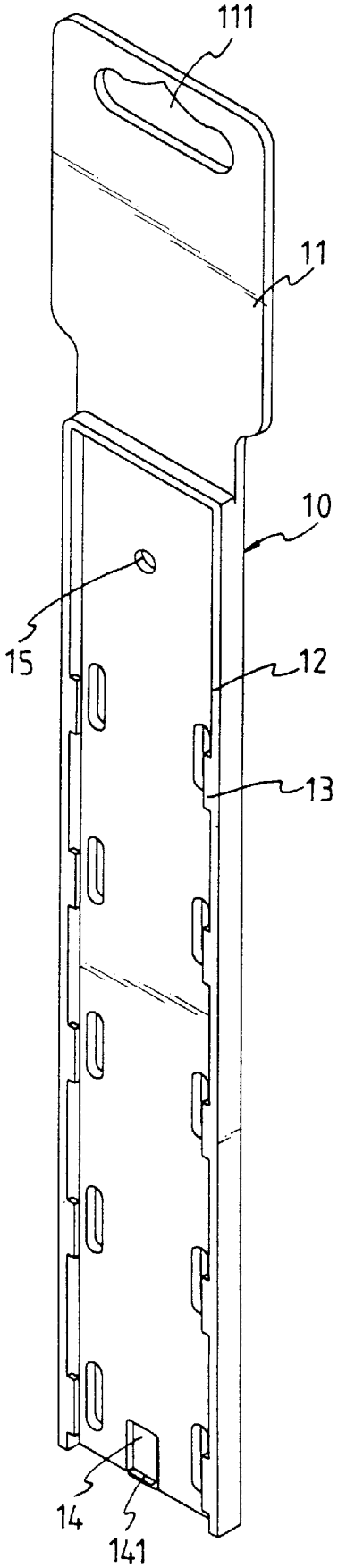
FIG. 2 is a perspective view of the back plate of the socket displaying device in accordance with the present invention.
Figure 3:
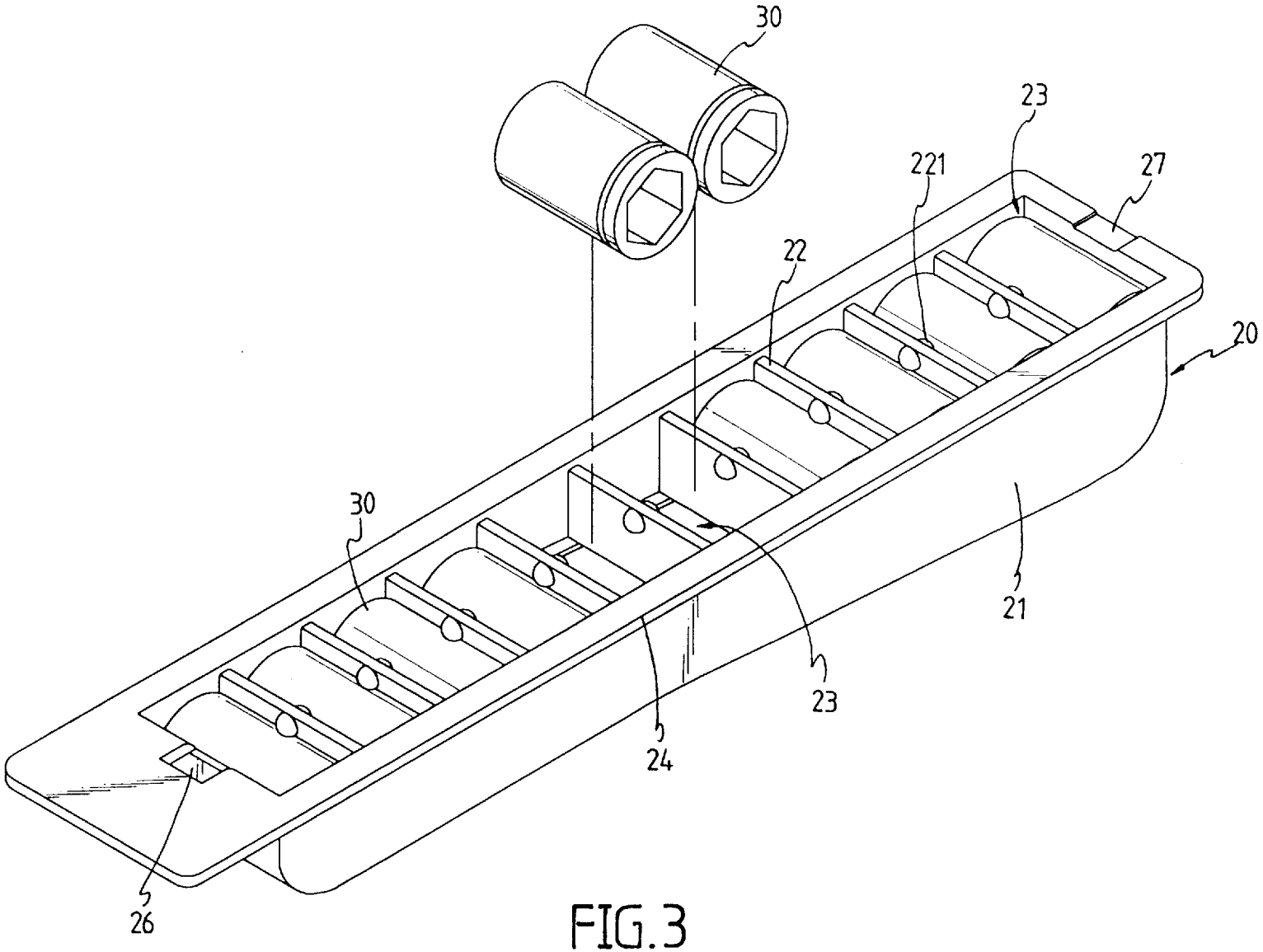
FIG. 3 is an exploded view of the frame in accordance with the present invention and the sockets to be received in the frame.
Figure 4:
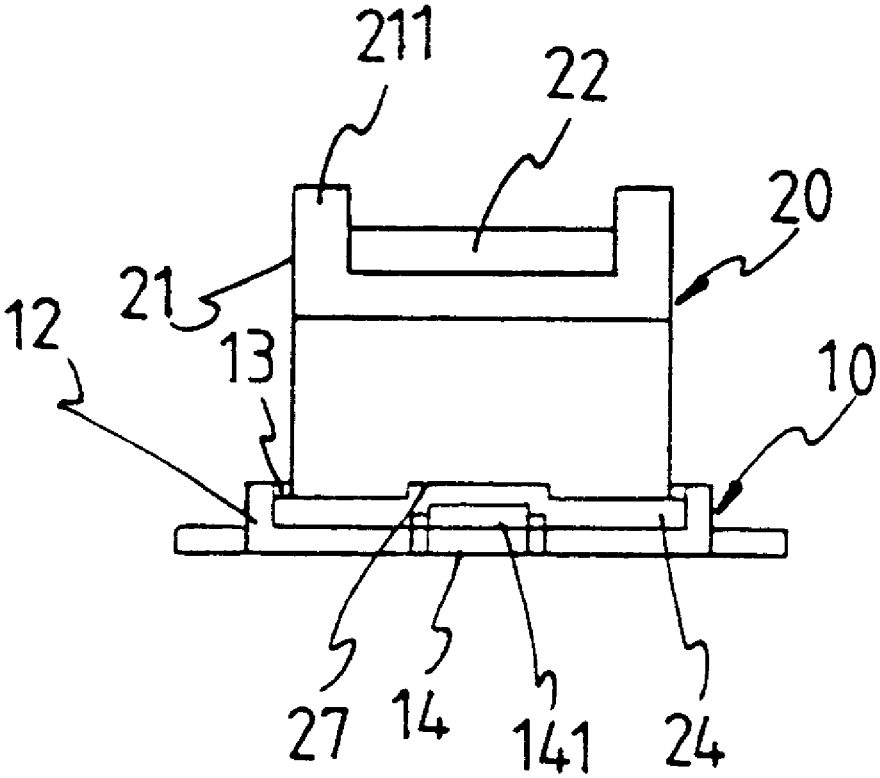
FIG. 4 is an end illustrative view to show the frame is engaged with the back plate

Referring to FIGS. 1 to 4, the socket displaying device in accordance with the present invention comprises a back plate 10 having a rectangular frame 12 and a plurality of protrusions 13 extending from two sides of the rectangular frame 12 so as to define two grooves. A plate 14 is connected to the first end of the back plate 10 and a stop 141 extends from the distal end of the plate 14. A leading plate 111 extends from the second end of the back plate 10. The leading plate 111 has a slot 111 defined therethrough so that the back plate 10 can be hung on a wall. A hole 15 is defined through the second end of the back plate 10.

A frame 20 has two rails 24 on two sides thereof so as to be slidably engaged with the grooves of the back plate 10. Two side plates 21 extend from the frame 20 and a plurality of boards 22 are connected between the two side plates 21 so as to define a plurality of chambers 23 in each of which a socket 30 can be received. Each board 22 has two bosses 221 respectively extending from two surfaces thereof so that the socket 30 is inserted into the chamber between two boards 22 by force-fitting the socket 30 over the two bosses 221. Each of the side plates 21 has a flange 211 extending toward the other side plate 21 so that the socket 30 will not drop between the two side plates 21. The frame 20 has a recess 27 defined in the first end thereof and the recess 27 is located in opposite to the two side plate sides 21. Therefore, when the frame 20 is moved relative to the back plate 10, the stop 141 can pass through the recess 27.

Figure 5:
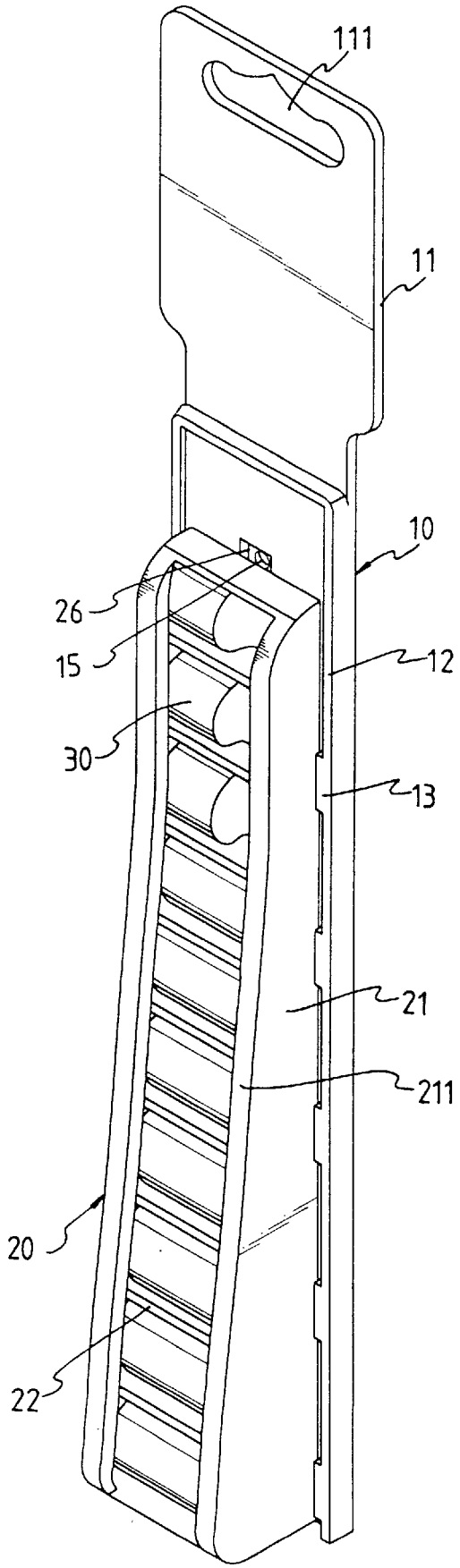
FIG. 5 is a perspective view of the socket displaying device in accordance with the present invention with sockets received in the frame of the device and the frame is located in its first position.
Figure 6:
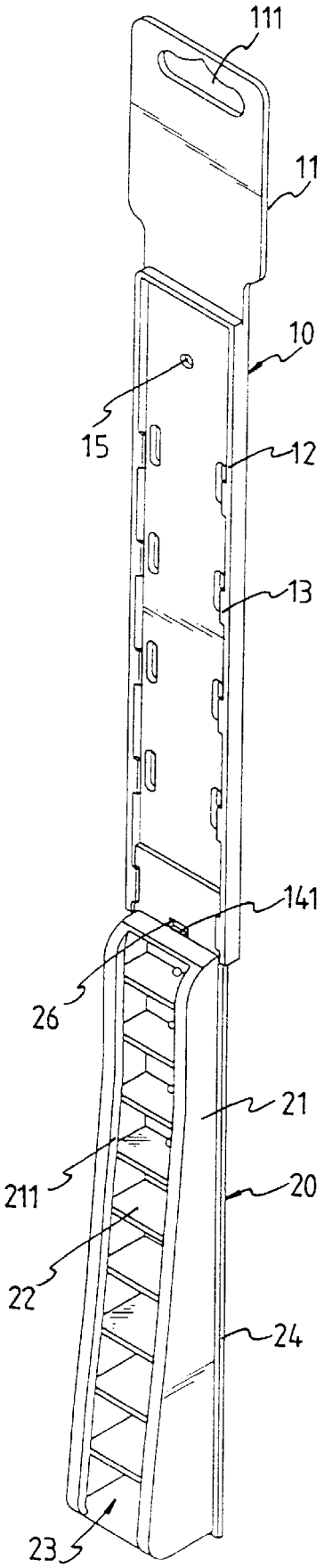
FIG. 6 is a perspective view of the socket displaying device in accordance with the present invention wherein the frame is located in its second position.
Figure 7:
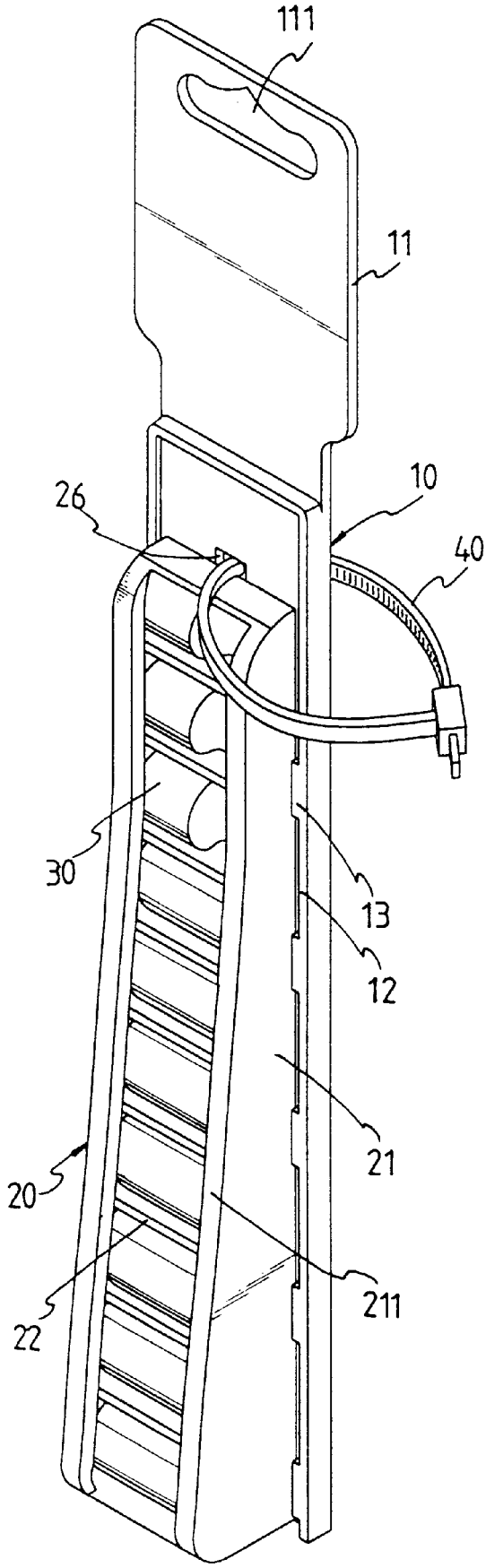
FIG. 7 is a perspective view of the socket displaying device in accordance with the present invention wherein a tie strip extends through the hole and the aperture so secure the frame to the back plate.

Therefore, as shown in FIG. 5, the first end of the frame 20 is engaged with the stop 141 when the frame 20 is located in a first position. An aperture 26 is defined in the second end of the frame 20 so as to engage with the stop 141 when the frame is located in a second position as shown in FIG. 6. Referring to FIG. 7, it is to be noted that when the frame 20 is in its first position, the hole 15 is in alignment with the aperture 26 of the frame 20 so that a tie strip 40 may extend through the hole 15 in the back plate 10 and the aperture 26 in the frame 20 so as to secure the frame 20 to the back plate 10.

The socket displaying device of the present invention can be displayed in a hardware store and the sockets 30 can be seen touched via the two side plates 22 of the frame 20. The device can also be used as a tool rack and is easily carried with the users. The sockets 30 are easily taken from or inserted into the frame 20 by pulling the frame 20 relative to the back plate 10 to the position where the desired chamber 23 is accessible.

While we have shown and described various embodiments in accordance with the present invention, it should be clear to those skilled in the art that further embodiments may be made without departing from the scope and spirit of the present invention.

What is claimed is:

1. A socket displaying device comprising:

a back plate having two grooves defined in two sides thereof and a stop extending from the first end of said back plate, and a frame having two rails on two sides thereof and two side plates extending from said frame, said two rails slidably engaged with said grooves of said back plate, a plurality of boards connected between said two side plates, each of said side plates having a flange extending toward the other side plate, said frame having a first end which is engaged with said stop when said frame is located in a first position, an aperture defined in the second end of said frame so as to engage with said stop when said frame is located in a second position.

2. The socket displaying device as claimed in claim 1, wherein each board has two bosses respectively extending from two surfaces thereof.

3. The socket displaying device as claimed in claim 1, wherein said back plate has a hole defined through the second end thereof and said hole is in alignment with said aperture of said frame.

4. The socket displaying device as claimed in claim 1, wherein said back plate has a leading plate extending from the second end thereof, said leading plate having a slot defined therethrough.

5. The socket displaying device as claimed in claim 1, wherein said back said frame has a recess defined in the first end thereof and said recess is located in opposite to said two side plate sides.

* * * * *